US011203097B2

(12) United States Patent
Chiang

(10) Patent No.: US 11,203,097 B2
(45) Date of Patent: Dec. 21, 2021

(54) SOCKET

(71) Applicant: SHIN YING ENTPR CO., LTD., Taichung (TW)

(72) Inventor: Wen-Hung Chiang, Taichung (TW)

(73) Assignee: SHIN YING ENTPR CO., LTD., Taichung (TW)

( * ) Notice: Subject to any disclaimer, the term of this patent is extended or adjusted under 35 U.S.C. 154(b) by 337 days.

(21) Appl. No.: 16/419,697

(22) Filed: May 22, 2019

(65) Prior Publication Data

US 2020/0368880 A1 Nov. 26, 2020

(51) Int. Cl.
*B25B 13/10* (2006.01)
*B25B 13/06* (2006.01)

(52) U.S. Cl.
CPC ..... *B25B 13/102* (2013.01); *B25B 13/06* (2013.01)

(58) Field of Classification Search
CPC ..... B25B 13/02; B25B 13/06; B25B 13/102
See application file for complete search history.

(56) References Cited

U.S. PATENT DOCUMENTS

2012/0137837 A1* 6/2012 Souma ..... B25B 13/102 81/124.3

FOREIGN PATENT DOCUMENTS

| | | | |
|---|---|---|---|
| JP | 3216900 | U | 6/2018 |
| TW | M338720 | U | 8/2008 |
| TW | D185897 | S | 10/2017 |
| TW | I643709 | B | 12/2018 |

* cited by examiner

*Primary Examiner* — David B. Thomas
(74) *Attorney, Agent, or Firm* — Muncy, Geissler, Olds & Lowe, P.C.

(57) ABSTRACT

A socket includes a first and a second sleeve members. The first sleeve member has a first end for connecting to a driving tool and a second end having a first connecting portion for sleeving onto a first fastener, and has an internal space and an internal circumferential wall. The second sleeve member is movably inserted into the internal space and has an external circumferential wall and a second connecting portion connected together. The second connecting portion is for sleeving onto a second fastener whose size is different from a size of the first fastener. One of the external and the internal circumferential walls is tapered from the first end toward the second end to form a gap. The other one of the external and the internal circumferential walls has a restriction unit extending into the gap.

10 Claims, 5 Drawing Sheets

SOCKET

BACKGROUND OF THE INVENTION

Field of the Invention

The present invention relates to a socket.

Description of the Prior Art

Sockets are common tools in factories. A conventional socket is shown in patents TW D185897 and TW M338720. The socket is used with a driving tool for rotating fasteners, such as nuts or bolts. The driving tool can be a wrench, a pneumatic tool, or an electric-powered tool.

However, to fit fasteners in various sizes and types, plural kinds of sockets have to be prepared. As a result, the factory has to store plural sockets, and the user has to change the socket during operation to fit the fastener so as to reduce the efficiency.

SUMMARY OF THE INVENTION

The main object of the present invention is to provide a socket having connecting portions in various sizes. Thus, the user can choose one of the connecting portions according to the size of fastener to be rotated so that the user doesn't have to change the socket for fasteners in different sizes.

To achieve the above and other objects, the socket of the present invention includes a first sleeve member and a second sleeve member.

The first sleeve member has a first end for connecting to a driving tool and a second end having a first connecting portion for sleeving onto a first fastener. The first sleeve member further has an internal space and an internal circumferential wall surrounding the internal space. The first connecting portion is connected with the internal circumferential wall. The second sleeve member is movably inserted into the internal space and has an external circumferential wall and a second connecting portion connected together. The external circumferential wall and the internal circumferential wall face each other. The second connecting portion is adapted for sleeving onto a second fastener whose size is different from a size of the first fastener. One of the external circumferential wall and the internal circumferential wall is tapered from the first end toward the second end to form a gap between the external circumferential wall and the internal circumferential wall. The other one of the external circumferential wall and the internal circumferential wall has a restriction unit extending into the gap.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
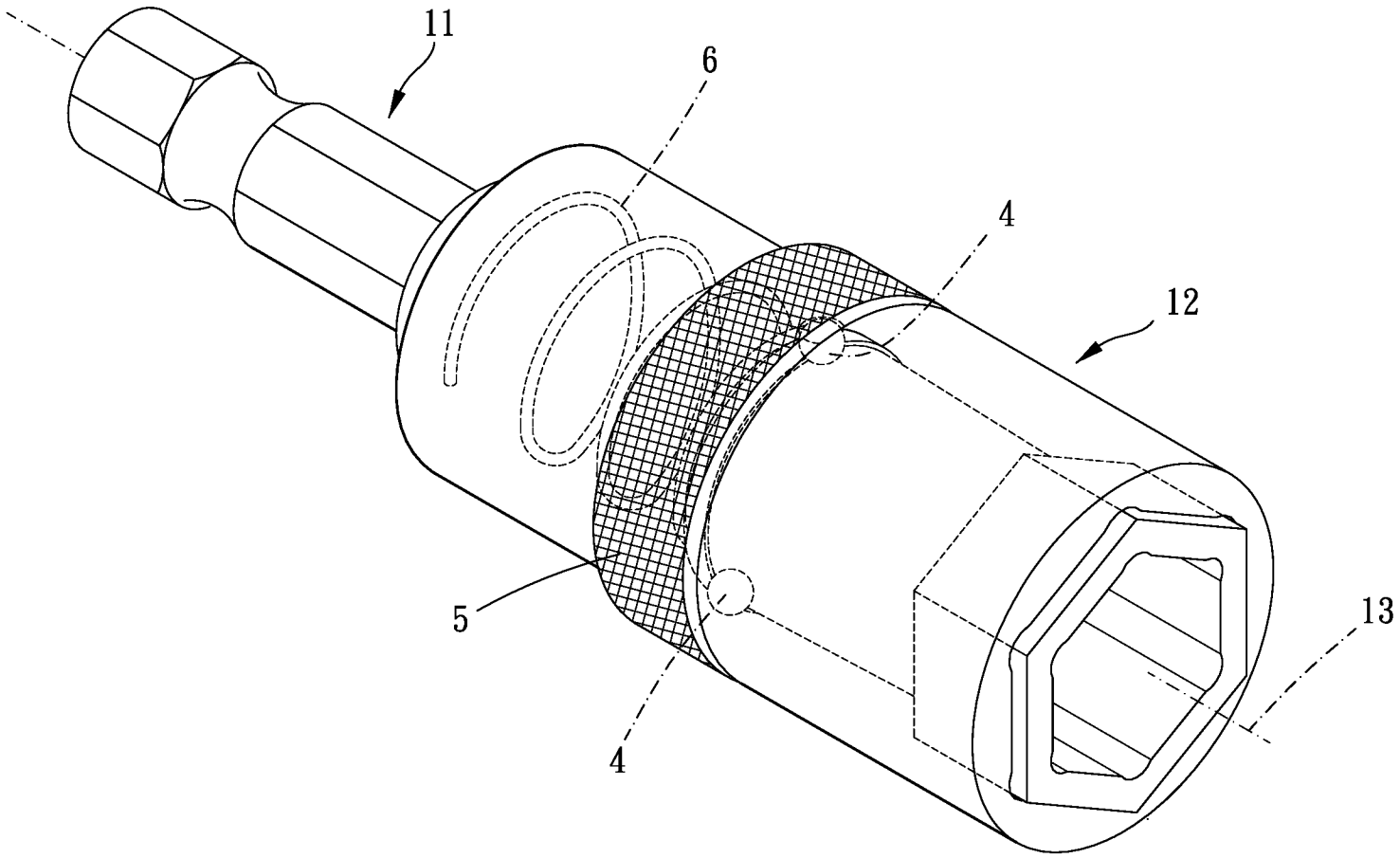
FIG. 1 is a stereogram of the present invention.
Figure 2:
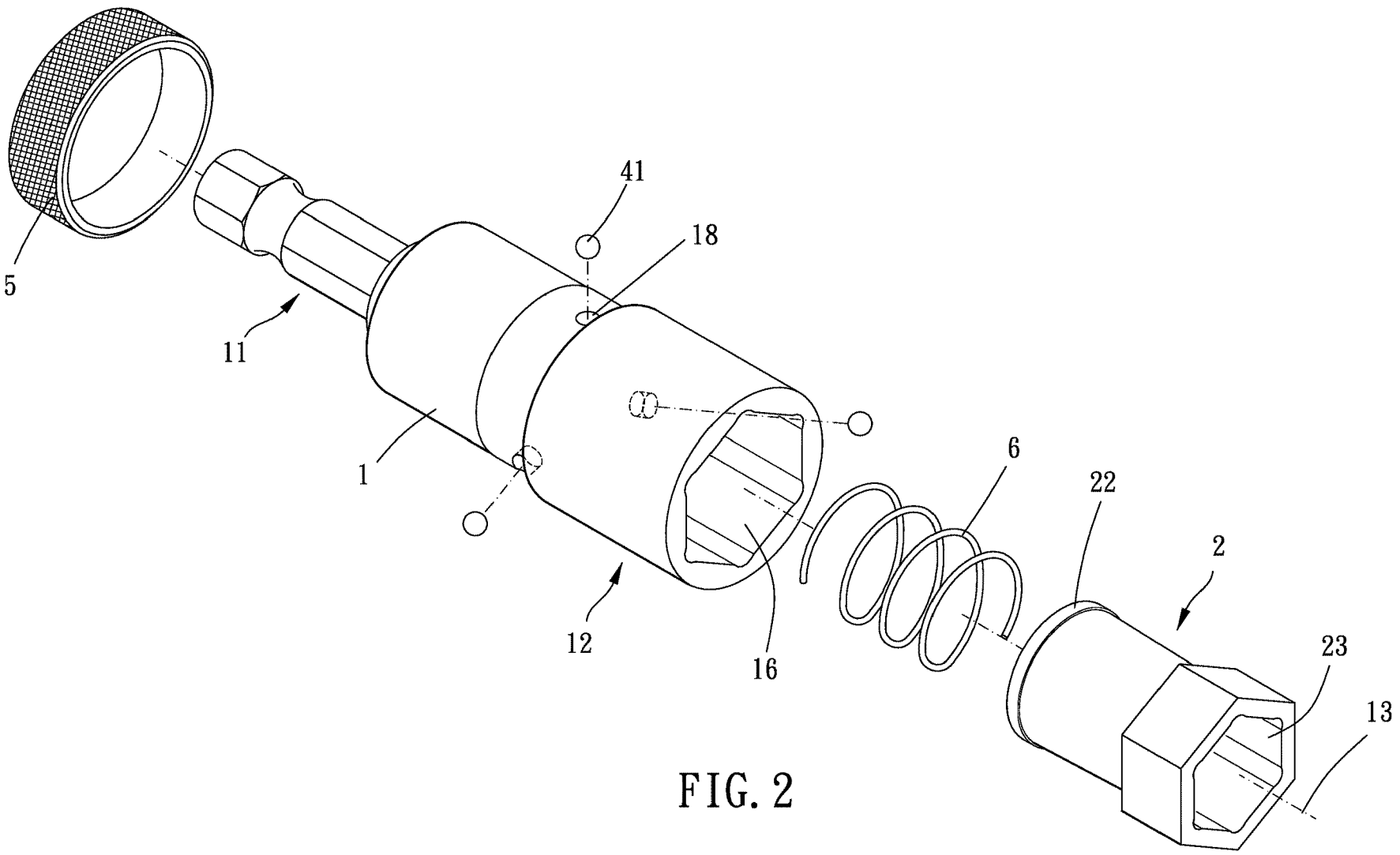
FIG. 2 is a breakdown drawing of FIG. 1.
Figure 3:
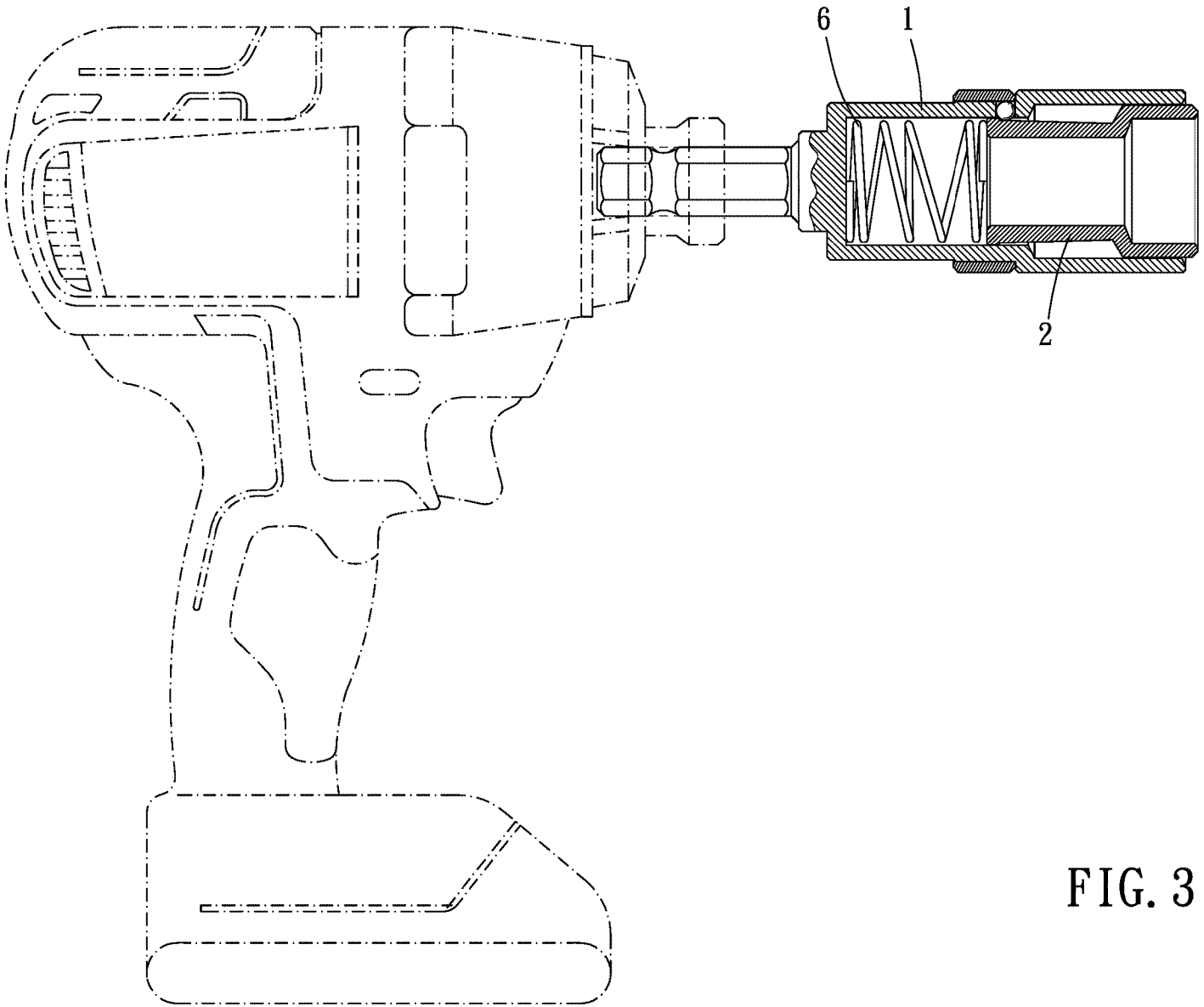
FIG. 3 is an illustration showing a socket of the present invention engaging with a driving tool.
Figure 4:
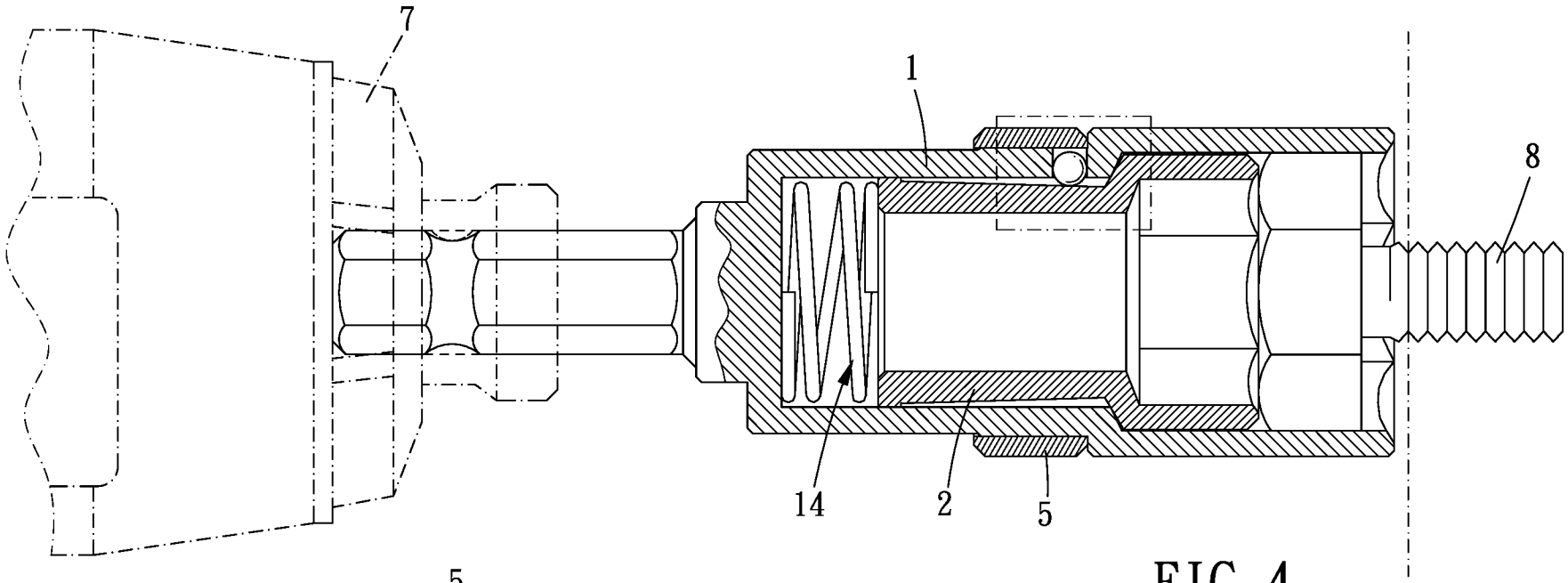
FIG. 4 is an illustration of use of FIG. 1.
Figure 5:
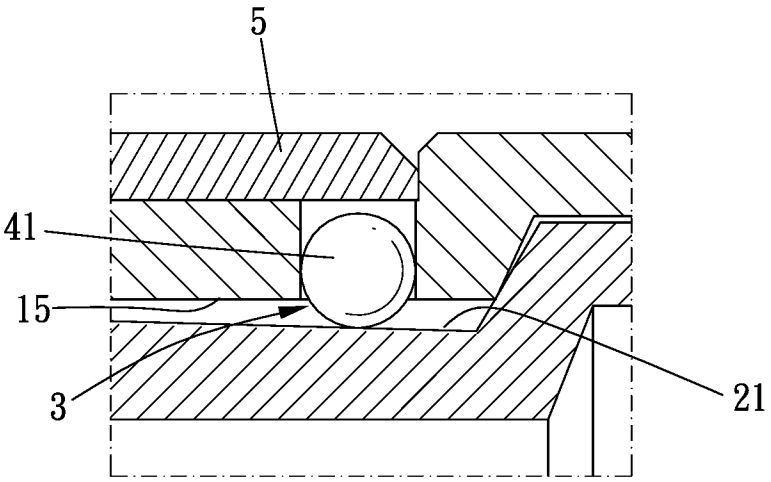
FIG. 5 is a partial enlargement of FIG. 3.
Figure 6:
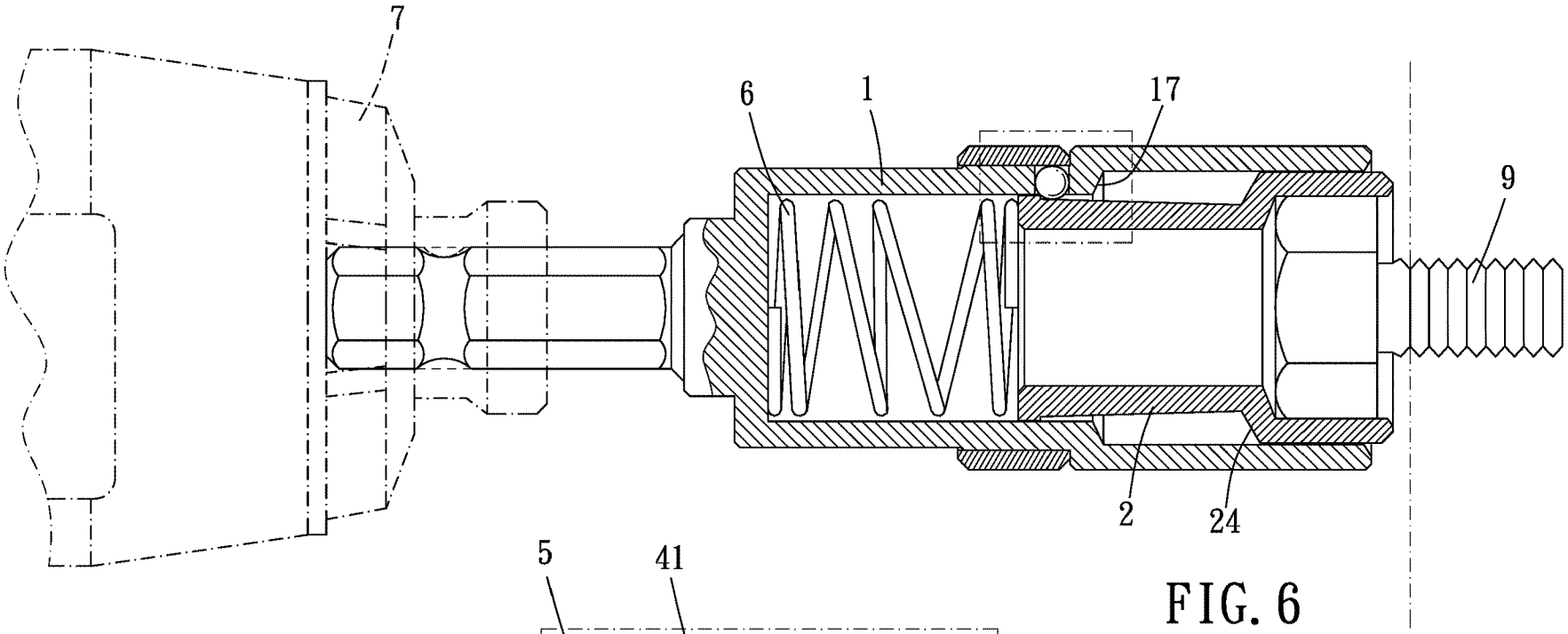
FIG. 6 is an illustration of use of FIG. 1.
Figure 7:
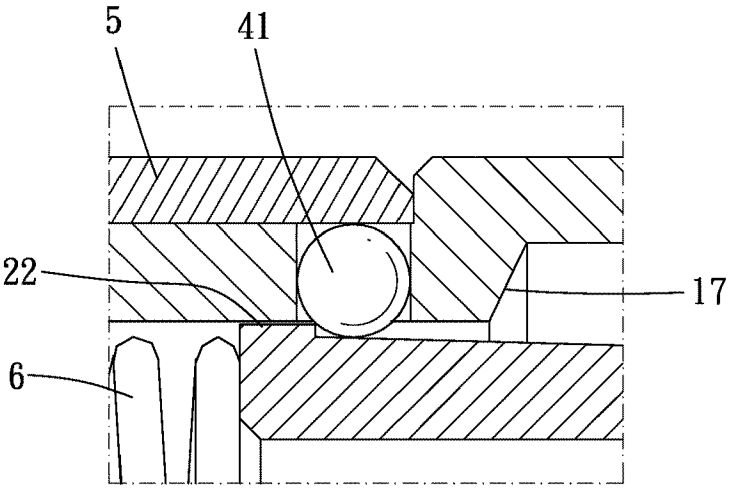
FIG. 7 is a partial enlargement of FIG. 6.

Please refer to FIG. 1 to FIG. 7, the socket of the present invention includes a first sleeve member 1 and a second sleeve member 2.

The first sleeve member 1 has a first end 11 for connecting to a driving tool 7 and a second end 12 having a first connecting portion 16 for sleeving onto a first fastener 8. The first sleeve member 1 further has an internal space 14 and an internal circumferential wall 15 surrounding the internal space 14. The first connecting portion 16 is connected with the internal circumferential wall 15. The second sleeve member 2 is movably inserted into the internal space 14 and has an external circumferential wall 21 and a second connecting portion 23 connected together. The external circumferential wall 21 and the internal circumferential wall 15 face each other. The second connecting portion 23 is adapted for sleeving onto a second fastener 9 whose size is different from a size of the first fastener 8. One of the external circumferential wall 21 and the internal circumferential wall 15 is tapered from the first end 11 toward the second end 12 to form a gap 3 between the external circumferential wall 21 and the internal circumferential wall 15. The other one of the external circumferential wall 21 and the internal circumferential wall 15 has a restriction unit 4 extending into the gap 3.

Because the second sleeve member 2 is engaged with the first sleeve member 1, the socket has the first connecting portion 16 and the second connecting portion 23 in different sizes. Thus, the user doesn't have to change the socket. As a result, efficiency is improved, and the socket is easy to be stored. Besides, the second sleeve member 2 is movably inserted into the internal space 14 of the first sleeve member 1, so the suitable one of the first connecting portion and the second connecting portion is chosen automatically according to the size of the fastener when the socket is sleeved onto the fastener. For example, if the first fastener 8 is larger than the second connecting portion 23, the second sleeve member 2 is pushed by the first fastener 8 when the socket is sleeved onto the first fastener 8, and the first connecting portion 16 is sleeved onto the first fastener 8.

Specifically, the first sleeve member 1 and the second sleeve member 2 are manufactured respectively and assembled thereafter. Thus, the first sleeve member 1 and the second sleeve member 2 can be processed precisely so that the first sleeve member 1 and the second sleeve member 2 can slide with respect to each other smoothly. In addition, if the first sleeve member 1 or the second sleeve member 2 is damaged, only the damaged one has to be exchanged. In the present embodiment, the first connecting portion and the second connecting portion have cross-sections in the same polygonal shape, especially in hexagonal shape. However, in other possible embodiments, the cross-sections can be other polygonal shape. For example, the first connecting portion has a dodecagonal shaped cross-section, and the second connecting portion has a hexagonal shaped cross-section.

Preferably, the socket further includes an elastic member 6 arranged in the internal space 14. The elastic member 6 is biased between the first sleeve member 1 and the second sleeve member 2 so that the second connecting portion 23 tends to protrude above the first connecting portion 16. The smaller second connecting portion 23 is guided to abut against the first fastener 8 or the second fastener 9. If the second sleeve member 2 is pushed to move back to the internal space 14 by external force, the elastic member 6 pushes the second sleeve member 2 back to the first position when the external force disappears.

More specifically, the first sleeve member 1 has a central axis 13. An extension direction of the internal circumferential wall 15 is parallel to the central axis 13, and an extension direction of the external circumferential wall 21 is parallel to the central axis 13 too. The restriction unit 4 is protruded into the gap 3 from the internal circumferential wall 15. When the second sleeve member 2 moves toward the second end 12 along the central axis 13 to a first position, the restriction unit 4 and the external circumferential wall 21 are tight-fitted to abut against each other.

In the present embodiment, the first sleeve member 1 and the second sleeve member 2 are arranged co-axially. A length of the first sleeve member 1 is 2-3 times a length of the second sleeve member 2. The second sleeve member 2 has a smaller length to be easy to store. When the second sleeve member 2 moves to the first position, the length of the second connecting portion 23 protruded out of the first connecting portion 16 along the central axis 13 is 0.1-0.2 time the length of the second sleeve member 2. The protruded second connecting portion 23 is easier to sleeve onto the second fastener 9. When observed along a direction perpendicular to the central axis 13, an angle between an extension of the external circumferential wall 21 and an extension of the internal circumferential wall 15 is 0-5 degrees. Thereby, when the second sleeve member 2 moves to a first position, the restriction unit 4 can firmly abut against the external circumferential wall 21.

Preferably, the thickness of the second sleeve member 2 near the first end 11 is larger than the thickness of the second sleeve member 2 near the second end 12 to have a better structure strength for the restriction unit 4 to abut against.

On the other hand, a stopping flange 22 radially extends from the external circumferential wall 21. The restriction unit 4 is located between the stopping flange 22 and the first connecting portion 16. When the second sleeve member 2 moves to the first position, the restriction unit 4 abuts against the stopping flange 22 along the extension direction of the central axis 13. Thus, the second sleeve member 2 is prevented from detaching from the first sleeve member 1. However, in other possible embodiments, the stopping flange can be ignored.

The inner diameter of the first connecting portion 16 is larger than the diameter of the internal circumferential wall 15. A first stopping wall 17 traversly connects to the internal circumferential wall 15 and the first connecting portion 16 therebetween. The outer diameter of the second connecting portion 23 is larger than the diameter of the external circumferential wall 21. A second stopping wall 24 traversely connects to the external circumferential wall 21 and the second connecting portion 23 therebetween. When the second sleeve member 2 is moved by an external force toward the first end 11 to a second position, the first stopping wall 17 and the second stopping wall 24 abut against each other. Preferably, the first stopping wall 17 is obliquely connected to the internal circumferential wall 15 and the first connecting portion 16, and the second stopping wall 24 is oblique at an angle corresponding to the angle that the first stopping wall 17 is oblique.

The restriction unit 4 includes at least one rolling ball 41. The at least one rolling ball 41 is rollably disposed on one of the first sleeve member 1 and the second sleeve member 2 to abut against the other one of the first sleeve member 1 and the second sleeve member 2. In the present embodiment, the at least one rolling ball 41 includes a plurality of the rolling balls arranged on the first sleeve member 1 equally-spaced to selectively abut against the second sleeve member 2.

Specifically, the first sleeve member 1 has at least one through hole 18 corresponding to the at least one rolling ball 41. In the present embodiment, the number of the at least one through hole 18 corresponds to the number of the rolling balls 41. The rolling balls 41 are received in the through holes 18 respectively. Each of the rolling balls 41 is partially protruded out of the internal circumferential wall 15 of the first sleeve member 1 to selectively abut against the external circumferential wall 21 of the second sleeve member 2.

Preferably, the socket further includes a fastening member 5 sleeved onto the first sleeve member 1 to radially press the at least one rolling ball 41 so that the at least one rolling ball 41 tends to move toward the second sleeve member 2.

In conclusion, the second sleeve member is slidably inserted into the first sleeve member, and the external circumferential wall of the second sleeve member is tapered so that a gap is formed between the first sleeve member and the second sleeve member. In addition, the restriction unit restricts the movement of the second sleeve member. Besides, the first sleeve member and the second sleeve member can be manufactured respectively. Thus, the socket of the present invention has a simple structure, easy operation, and is precise and quickly manufactured.

What is claimed is:

1. A socket, including:

a first sleeve member, having a first end for connecting to a driving tool and a second end having a first connecting portion for sleeving onto a first fastener, having an internal space and an internal circumferential wall surrounding the internal space, the first connecting portion being connected with the internal circumferential wall;

a second sleeve member, movably inserted into the internal space, having an external circumferential wall and a second connecting portion connected together, the external circumferential wall and the internal circumferential wall facing each other, the second connecting portion being adapted for sleeving onto a second fastener whose size is different from a size of the first fastener;

wherein one of the external circumferential wall and the internal circumferential wall is tapered from the first end toward the second end to form a gap between the external circumferential wall and the internal circumferential wall, the other one of the external circumferential wall and the internal circumferential wall has a restriction unit extending into the gap.

2. The socket of claim 1, wherein the first sleeve member has a central axis, the internal circumferential wall extends along a direction parallel to the central axis, the external circumferential wall extends along a direction oblique to the central axis, the restriction unit extends into the gap from the internal circumferential wall, when the second sleeve member moves toward the second end along the central axis to a first position, the restriction unit and the external circumferential wall are tight-fitted to abut against each other.

3. The socket of claim 2, wherein a stopping flange is radially protruded from the external circumferential wall, the restriction unit is located between the stopping flange and the first connecting portion, when the second sleeve member moves to the first position, the restriction unit abuts against the stopping flange along an extension direction of the central axis.

4. The socket of claim 2, wherein when observed along a direction perpendicular to the central axis, an angle between an extension of the external circumferential wall and an extension of the internal circumferential wall is larger than 0 degree but smaller than 5 degrees.

5. The socket of claim 1, wherein the first sleeve member has a central axis, an inner diameter of the first connecting portion is larger than a diameter of the internal circumferential wall, the first stopping wall traversely connects the internal circumferential wall and the first connecting wall therebetween, an outer diameter of the second connecting portion is larger than a diameter of the external circumferential wall, a second stopping wall traversely connects the external circumferential wall and the second connecting portion therebetween, when the second sleeve member is moved by an external force toward the first end to a second position, the first stopping wall and the second stopping wall abut against each other.

6. The socket of claim 1, wherein the restriction unit includes at least one rolling ball, the at least one rolling ball is rollably disposed on one of the first sleeve member and the second sleeve member in order to selectively abut against the other one of the first sleeve member and the second sleeve member.

7. The socket of claim 6, wherein the first sleeve member is formed with at least one through hole corresponding to the at least one rolling ball, the at least one rolling ball is received in the at least one through hole, the at least one rolling ball is protruded above the internal circumferential wall of the first sleeve member to selectively abut against the external circumferential wall of the second sleeve member tightly.

8. The socket of claim 7, further including a fastening member, the fastening member being sleeved onto the first sleeve member to radially press the at least one rolling ball so that the at least one rolling ball tends to move toward the second sleeve member.

9. The socket of claim 8, wherein the first sleeve member has a central axis, the internal circumferential wall extends along a direction parallel to the central axis, the external circumferential wall extends along a direction oblique to the central axis, the restriction unit extends into the gap from the internal circumferential wall, when the second sleeve member moves toward the second end along the central axis to a first position, the restriction unit and the external circumferential wall are tight-fitted to abut against each other; a stopping flange is radially protruded from the external circumferential wall, the restriction unit is located between the stopping flange and the first connecting portion, when the second sleeve member moves to the first position, the restriction unit abuts against the stopping flange along an extension direction of the central axis; when observed along a direction perpendicular to the central axis, an angle between an extension of the external circumferential wall and an extension of the internal circumferential wall is larger than 0 degree but smaller than 5 degrees; an inner diameter of the first connecting portion is larger than a diameter of the internal circumferential wall, the first stopping wall traversely connects the internal circumferential wall and the first connecting wall therebetween, an outer diameter of the second connecting portion is larger than a diameter of the external circumferential wall, a second stopping wall traversely connects the external circumferential wall and the second connecting portion therebetween, when the second sleeve member is moved by an external force toward the first end to a second position, the first stopping wall and the second stopping wall abut against each other; the socket further includes an elastic member, the elastic member is arranged in the internal space, the elastic member is biased between the first sleeve member and the second sleeve member to make the second connecting portion tend to protrude above the first connecting portion; when the second sleeve member moves to the first position, a length of the second connecting portion out of the first connecting portion along the central axis is 0.1-0.2 time a length of the second sleeve member along the central axis; a length of the first sleeve member along the central axis is 2-3 times the length of the second sleeve member; the first sleeve member and the second sleeve member are arranged co-axially; the at least one rolling ball includes a plurality of the rolling balls arranged on the first sleeve member equally-spaced; the first stopping wall connects to the internal circumferential wall and the first connecting portion obliquely, the second stopping wall is oblique at an angle corresponding to an angle that the first stopping wall is oblique; the first connecting portion and the second connecting portion have a same shape of cross-section which is polygonal; the second sleeve member has a larger thickness at the first end than a thickness thereof at the second end.

10. The socket of claim 1, further including an elastic member, the elastic member being arranged in the internal space, the elastic member being biased between the first sleeve member and the second sleeve member to make the second connecting portion tend to protrude above the first connecting portion.

* * * * *